US006739768B2

(12) United States Patent
Johnke et al.

(10) Patent No.: US 6,739,768 B2
(45) Date of Patent: May 25, 2004

(54) APPARATUS FOR PROCESSING PHOTOGRAPHIC MATERIALS

(75) Inventors: Michael Johnke, Burgel/Ot Gniebsdorf (DE); Hans Schluter, Gera (DE)

(73) Assignee: Agfa-Gevaert Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/664,647

(22) Filed: Sep. 18, 2003

(65) Prior Publication Data

US 2004/0081456 A1 Apr. 29, 2004

(30) Foreign Application Priority Data

Sep. 24, 2002 (EP) ..... 02021192

(51) Int. Cl.[7] ..... G03D 13/00; G03D 13/06; G03D 17/00

(52) U.S. Cl. ..... 396/578; 396/589; 396/594; 396/599; 355/27

(58) Field of Search ..... 396/578, 589, 396/599–627, 594; 355/27–29, 53

(56) References Cited

U.S. PATENT DOCUMENTS

| | | | |
|---|---|---|---|
| 4,417,260 | A | 11/1983 | Kawai et al. |
| 4,764,815 | A | 8/1988 | Landsman |
| 4,774,533 | A | 9/1988 | Muller |
| 4,833,325 | A | 5/1989 | Torii et al. |

FOREIGN PATENT DOCUMENTS

| | | | |
|---|---|---|---|
| DE | 36 05 463 | C1 | 4/1987 |
| EP | 0583513 | A1 | 2/1994 |

*Primary Examiner*—D. Rutledge
(74) *Attorney, Agent, or Firm*—Darby & Darby

(57) ABSTRACT

An apparatus for processing photographic materials has at least one photographic processing station enclosed in a housing. The housing and the processing station are each independently mounted through their own oscillation-damping connections to a common support base, so that any connections between the housing and the processing station run exclusively through the common support base.

12 Claims, 1 Drawing Sheet

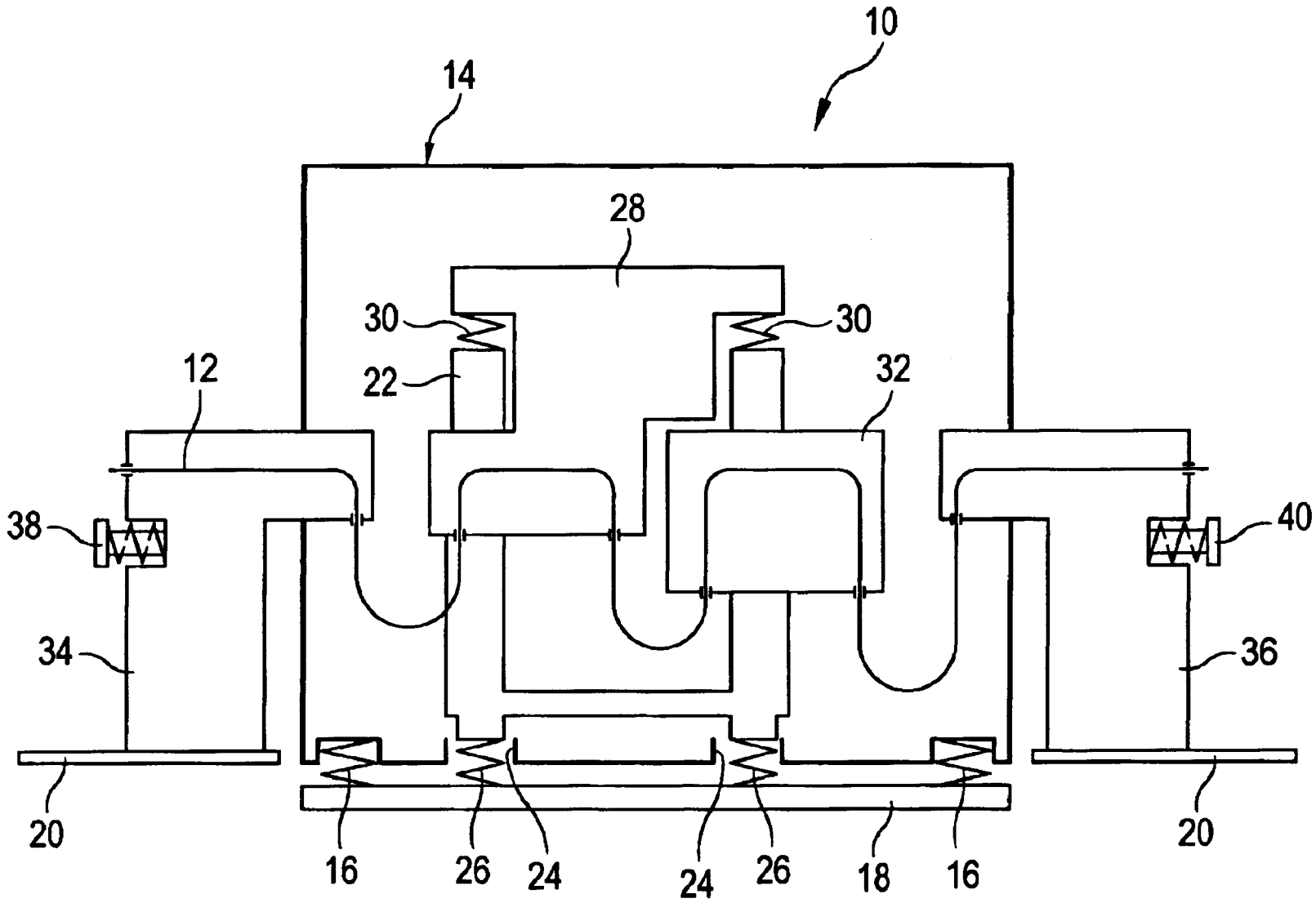
10
14
12
38
34
20
30
22
28
32
30
40
36
20
16
18
26
24
24
26
16

APPARATUS FOR PROCESSING PHOTOGRAPHIC MATERIALS

BACKGROUND OF THE INVENTION

The invention relates to an apparatus for processing photographic materials (also referred to as a photo-processing machine) with a housing that accommodates at least one processing station.

In photo-processing machines, for example exposure devices that serve to project images onto photographic paper, in particular laser-based exposure devices, or in scanner devices that serve to scan developed photographic films, have a protective light-impermeable housing containing the individual processing stations by which the photographic material is processed. Devices of this kind work with a very high level of precision and at the same time with a very high processing speed. Because of the high precision and the fast processing speed, a processing station should be as much as possible kept free of any shocks or tremors while the system is in operation, as even the slightest disturbances can excite oscillations of the processing station with harmful effects on the desired quality of the work product.

To avoid shocks that can cause oscillations in the processing station, shock-damping measures are known as a state-of-the-art solution for damping any shocks that may occur.

As an example, DE 36 05 463 discloses a photo-processing system in which the processing station, while being enclosed in a housing, is fastened independently and directly to the floor through appropriate oscillation-damping elements. However, this concept presents the problem that shocks acting on the housing can be transmitted through the floor to the processing station in spite of the damping elements. The fine adjustment that is required when the equipment is installed presents a further problem, because the transfer of the light-sensitive material between the housing-mounted transport devices and the processing station requires a high degree of precision.

A scanning apparatus for photographic materials is disclosed in U.S. Pat. No. 4,417,260, where the scanning station is mounted in a housing by way of oscillation dampers. This concept likewise has the problem that possible shocks acting directly on the housing are transmitted to the processing station inside the housing.

OBJECT AND SUMMARY OF THE INVENTION

The present invention therefore has the objective to propose a processing apparatus for photographic materials in which the quality of the work product is not negatively affected by the kind of shocks that occur in normal operating situations and may affect the housing or its immediate vicinity.

An apparatus for processing photographic materials in accordance with the invention has a housing and, enclosed in the housing, at least one processing station that performs a processing operation on the photographic materials. According to the invention, the housing and the processing station are connected exclusively through at least one common support base, and each of the housing and the processing station is attached through its own oscillation-damping connection to the common support base.

In the processing apparatus according to the invention, the connection between the housing and the processing station occurs exclusively along the indirect connection path through the common support base. Except for this indirect connection, the processing station is arranged inside the housing in total separation from the housing. Furthermore, the concept of connecting the processing station as well as the housing to the common support base through their own respective oscillation-damping mounts achieves two essential benefits. On the one hand, shocks affecting the housing are intercepted already by the damping connection between the housing and the support base, while on the other hand any oscillations that may nevertheless have reached the support base due to strong impacts on the housing are prevented by the damping connection between the support base and the processing station from being transmitted to the processing station.

The oscillation-damped arrangement of the processing station inside the housing avoids the problem of oscillation-transmitting bridges between the modules, so that disturbances which in a normal operating system act on the housing or the support base are not transmitted to the processing station and as a result, the processing station will be able to deliver the desired high quality of the work product.

In a preferred embodiment of the inventive apparatus, the processing station is held through oscillation-damping connections in an intermediate frame which, in turn is fastened to the support base. As a result of this arrangement, oscillations that may be transmitted to the intermediate frame are absorbed by the inertial mass of the frame.

In a particularly preferred arrangement, the intermediate frame is connected to the support base through oscillation-damping elements, whereby the overall damping effect is further enhanced.

Oscillations are also generated by the transport device by which the photographic materials are fed to the processing station. The invention therefore proposes an arrangement where the transport device for the photographic materials is not fastened directly to the processing station, but to a part of the intermediate frame in immediate proximity to the processing station. This concept prevents that oscillations originating from the transport device are transmitted to the processing station.

In order to prevent the risk that oscillations could be excited in the housing or the intermediate frame as a result of shocks or disturbances, it is further proposed to arrange dead weights at specific locations of the housing and/or the intermediate frame in order to increase the mass of the housing and/or the intermediate frame, so that the mass to be excited into oscillation in the event of a shock would have a high amount of inertia. This concept further improves the oscillation isolation of the processing station.

A further embodiment of the invention is particularly preferred if the apparatus is used to produce projected images on photographic materials such as a light-sensitive photographic paper either from a given graphic object or from digital image data. In this case, the invention proposes an arrangement where the attachment mounts of the processing station or, if provided, the attachment mounts of the intermediate frame, pass through light-sealed passage openings in the floor of the housing.

In order to allow a continuous working mode of photographic processing systems, it is customary to arrange docking stations at the housing for feeding and discharging devices, that serve to deliver additional photographic materials or remove processed materials while the system is in operation. To ensure that shocks caused by the docking of the feeding and discharging devices are transmitted to the apparatus housing only with a softened intensity, it is further proposed in accordance with the invention to provide at least one damping device per docking station to effectively dampen the docking and uncoupling movements of the feeding and discharging devices.

As a means for damping oscillations in all places mentioned in the foregoing description, it is preferred to use oscillation dampers that ensure the lowest possible resonance frequency of the system. The aim is for a resonance frequency below 30 Hz. An especially high degree of oscillation damping can be achieved if the resonance frequency of the system is below 15 Hz.

The principle of an oscillation isolation between the processing station and the housing in accordance with the foregoing description is used with particular preference in a photo-processing apparatus for exposing photographic materials. In this application of the invention, the processing station serves as exposure station in which images are projected onto photographic materials. Especially if the image on the photographic material is drawn by means of a laser light source, it is highly important that the processing station exposes the light-sensitive material without oscillations, because in a line-by-line exposure process of this kind even the slightest relative movements between the exposure station and the material being exposed are harmful to the quality of the end product. Oscillations transmitted into the exposure station manifest themselves in the output images through slight variations in the spacing between individual exposed image lines. The human eye is extremely sensitive especially to image defects of this nature and can recognize oscillations even if they are so slight that they can barely be registered with measuring instruments.

As a further area of application for the principle according to the invention, the inventive apparatus is used as a scanner device where the processing station serves to scan a developed film to produce the image data representing the original photographic image existing on the developed film. In this application, too, it is essential that the processing station not be subjected to oscillations during the scanning of the given graphic objects.

BRIEF DESCRIPTION OF THE DRAWING

Additional features and advantages of the invention may be learned from the following description of a preferred embodiment which is referenced against the attached drawing.

The single drawing figure represents an apparatus for processing photographic materials shown in a side view.

DETAILED DESCRIPTION OF A PREFERRED EMBODIMENT

The drawing figure gives a schematic view of an apparatus 10 for projecting images of given graphic objects onto a light-sensitive material 12 that is transported through the apparatus 10.

The apparatus 10 has a housing 14 that is fastened to a base plate 18 by way of first oscillation dampers 16. The base plate 18 is configured separately from the ground 20 on which it rests.

An intermediate frame 22 is arranged inside the housing 14 and likewise fastened to the base plate 18. The housing 14 has light-sealed passage openings 24 for the attachment mounts that connect the intermediate frame 22 to the base plate 18. The intermediate frame 22 is fastened through second oscillation dampers 26.

Suspended in the intermediate frame 22 is a processing station 28, which is held in the intermediate frame 22 by way of third oscillation dampers 30. The processing station 28 shown in the drawing is used to expose the light-sensitive material 12 to produce images of graphic objects that are present in the form of digital image data.

Furthermore, a transport device 32 for the light-sensitive material 12 is attached to the housing 14. The transport device 32, which advances the light-sensitive paper in an intermittent motion, also contains a so-called punch marker which serves to punch perforations into the paper in a certain pattern that identifies each individual order. The arrangement of attaching the transport device 32 to the housing 14 has the result that oscillations of the drive mechanisms and shocks originating from the punch marker are effectively damped before they can reach the processing station 28.

Also arranged at the housing 14, shown in the right-hand portion of the drawing, is a docking station 36 for delivering the light-sensitive material 12 to the apparatus. At the opposite end, shown in the left-hand portion of the drawing, there is a docking station 34 for discharging the light-sensitive material 12 from the apparatus.

When the apparatus is in operation, a cassette on wheels (not shown in the drawing) for the photo-sensitive material 12 is docked to docking station 36, so that a sufficient supply with light-sensitive material 12 is assured. To take the exposed light-sensitive material 12 out of the apparatus, another cassette of the same kind (likewise not shown in the drawing) which receives the exposed light-sensitive material, is coupled to the docking station 34 at the opposite end of the housing 14.

As new lights-sensitive material 12 is continuously fed and discharged in the operation of the apparatus 10, empty cassettes from which the light-sensitive material has been spent and full cassettes containing the exposed material 12 are uncoupled at regular intervals from the respective docking stations 36 and 34 and replaced by cassettes full of new light-sensitive material 12 to be exposed and by empty cassettes.

To prevent the full force of the shocks that occur in the docking and uncoupling of the cassettes from being transmitted to the housing 14, the docking stations 34 and 36 are equipped with damping devices 38 and 34, respectively. In the rough everyday routine of photographic laboratories, particularly the docking of the movable cassettes on wheels often causes hard impacts that are normally transmitted in their full force to the housing. With the damper devices 38 and 40 at the docking stations 34 and 36, respectively, most of the shock intensity is now being absorbed.

With the chain of the four damper devices 38/40, 16, 26 and 30 arranged in series between the cassettes and the laser-based exposure device, all of the shocks and tremors acting from the outside can be safely absorbed. But also oscillations originating within the apparatus which could cause visible irregularities in the image are all channeled away through the housing 14 and thus absorbed in the dampers 16, 26 and 30, so that they cannot propagate all the way to the exposure device.

Even if shocks that occur, e.g., at one of the docking stations 34 and 36 are transmitted to the housing 14, this will cause oscillations only in the housing 14. However, due to the first oscillation dampers 16, these oscillations are either not transmitted to the base plate 18 at all or only to a limited extent. Even if the shocks acting on the housing 14 are so large as to put the base plate 18 into oscillation, too, the second oscillation dampers 26 will prevent the oscillations from being transmitted to the intermediate frame 22 and thus to the processing station 28.

Besides externally generated shocks, oscillations originating from the intermediate frame 22 itself are also safely prevented from reaching the laser-based exposure device due to the third oscillation dampers 30 through which the processing station 28 is held on the intermediate frame 22.

To prevent oscillation of the intermediate frame 22, the latter is preferably of a heavyweight construction. It is also possible to attach additional weights (not shown) to the intermediate frame 22.

The apparatus 10 of the foregoing description serves to project images from given graphic objects onto the light-sensitive material 12. However, the principle described above can also be realized in an apparatus for scanning exposed photographic films, wherein the processing station is configured as a scanning station and suspended in an analogous manner on an intermediate frame in an oscillation-damping arrangement.

As all components of the apparatus are arranged on a common support base, the setup is easily adjustable. The alignment of the individual components in relation to each other is not subject to any further change after the setup adjustment.

What is claimed is:

1. An apparatus for processing a photographic material, comprising a housing, at least one processing station enclosed in the housing and operable to process a photographic material, and at least one common support base on which the housing and the at least one processing station are mounted, wherein the housing and the at least one processing station are connected to each other exclusively through the at least one common support base, and wherein each of the housing and the at least one processing station is attached through its own individual oscillation-damping connection to the at least one common support base.

2. The apparatus of claim 1, further comprising an intermediate frame mounted on the at least one common support base and holding the at least one processing station, wherein a first oscillation-damping connection between the at least one processing station and the at least one common support base is arranged between the at least one processing station and the intermediate frame.

3. The apparatus of claim 2, wherein a second oscillation-damping connection between the at least one processing station and the at least one common support base is arranged between the intermediate frame and the at least one common support base.

4. The apparatus of claim 3, further comprising a transport device operable to advance the photographic material through the apparatus, wherein said transport device is supported on the intermediate frame.

5. The apparatus of claim 2, further comprising a dead weight attached to at least one of the housing and the intermediate frame as a means of increasing inertial mass.

6. The apparatus of claim 1, wherein the housing has a floor portion with light-sealed passage openings through which the processing station is mounted to the support base.

7. The apparatus of claim 2, wherein the housing has a floor portion with light-sealed passage openings through which the intermediate frame is mounted to the support base.

8. The apparatus of claim 1, further comprising at least one docking station arranged at the housing and operable for coupling to and uncoupling from the apparatus one of a photographic material feeding device and a photographic material discharging device, wherein said at least one docking station comprises a damping device for the damping of movements associated with said coupling and uncoupling.

9. The apparatus of claim 1, further comprising an intermediate frame mounted on the at least one common support base and holding the at least one processing station, wherein said individual oscillation-damping connection comprises oscillation dampers interposed between the support base and the housing, between the support base and the processing station, and in at least one of the places where the intermediate support frame meets the at least one common support base and the at least one processing station, wherein the apparatus is excitable at a resonance frequency and said oscillation dampers are designed to keep said resonance frequency below 30 Hz.

10. The apparatus of claim 9, wherein the oscillation dampers are designed to keep the resonance frequency below 15 Hz.

11. The apparatus of claim 1, wherein the apparatus is an exposure apparatus for producing an image of a given graphic object on the photographic material.

12. The apparatus of claim 1, wherein the apparatus is a scanning apparatus, the photographic material is a developed photographic film, and the processing station is operable to scan the photographic film to generate image data from a given image residing on the developed film.

* * * * *